United States Patent [19]

Tobin

[11] 3,992,021

[45] *Nov. 16, 1976

[54] SKI POLE GRIP

[75] Inventor: James E. Tobin, Sun Valley, Idaho

[73] Assignee: Scott USA, Sun Valley, Idaho

[ * ] Notice: The portion of the term of this patent subsequent to Apr. 29, 1992, has been disclaimed.

[22] Filed: Jan. 10, 1975

[21] Appl. No.: 539,025

Related U.S. Application Data

[63] Continuation-in-part of Ser. No. 391,690, Aug. 27, 1973, Pat. No. 3,880,443.

[52] U.S. Cl. ..... 280/11.37 H

[51] Int. Cl.[2] ..... A63C 11/22

[58] Field of Search ..... 280/11.37 B, 11.37 D, 280/11.37 H

[56] References Cited

UNITED STATES PATENTS

| | | | |
|---|---|---|---|
| 3,436,090 | 4/1969 | Lange et al. | 280/11.37 H |
| 3,451,688 | 6/1969 | McDonald | 280/11.37 H |
| 3,479,045 | 11/1969 | Miller | 280/11.37 H |
| 3,545,784 | 12/1970 | Alsop | 280/11.37 H |
| 3,565,451 | 2/1971 | Giambazi | 280/11.37 H |
| 3,662,433 | 5/1972 | Couttet | 280/11.37 |
| 3,879,048 | 4/1975 | Penney | 280/11.37 H |
| 3,880,443 | 4/1975 | Tobin | 280/11.37 H |

FOREIGN PATENTS OR APPLICATIONS

| | | | |
|---|---|---|---|
| 248,310 | 7/1964 | Austria | 280/11.37 H |
| 1,369,228 | 6/1964 | France | 280/11.37 H |
| 47-28076 | 11/1972 | Japan | 280/11.37 H |

*Primary Examiner*—Robert R. Song
*Assistant Examiner*—David M. Mitchell
*Attorney, Agent, or Firm*—Wegner, Stellman, McCord, Wiles & Wood

[57] ABSTRACT

A strapless ski pole grip includes an elongated body having an axial bore for receiving the shaft of a ski pole. The elongated body includes a radially extending, palm engaging stop which terminates in a wide base to support the entire palm of the skier's hand, back to his wrist. The ends of the elongated body project outwardly and sideways to form side fingers which are located to lie against the back of the skier's hand. The pair of fingers are resilient and move sideways when the ski pole becomes captured to allow sliding withdrawal of the skier's hand.

10 Claims, 8 Drawing Figures

SKI POLE GRIP

CROSS REFERENCE TO RELATED APPLICATION

This application is a continuation-in-part of my copending application entitled "Strapless Ski Pole Grip", Ser. No. 391,690, filed Aug. 27, 1973, now U.S. Patent No. 3,880,443.

BACKGROUND OF THE INVENTION

This invention relates to a ski pole grip which allows emergency release of a skier's hand while also providing improved support and retention characteristics during normal skiing conditions.

When a ski pole becomes captured in use, as by the basket becoming snagged on an object, conventional retention straps will bind the skier's hand to the captured ski pole and may create a serious injury. To obviate this problem, strapless ski pole grips have been developed, such as shown in U.S. Pat. No. 3,479,045 to Miller. Because such strapless grips have one or more projections which overlie only a small portion of the skier's hand, they do not provide sufficient retention characteristics for sudden, but not common, forces which may cause the skier to lose his grip and hence the ski pole. Retention can be improved by using a grip with a more sculptured body, such as shown in Austrian Pat. No. 248310 issued in 1966.

Some ski pole grips have used a "quick-release" type strap which does not have to be looped around the skier's wrist. Typically, the strap extends across the length of the grip body and forms a channel for the skier's hand. The strap may be located across the back of the skier's hand, as shown in Lange et al 3,436,090 and Couttet 3,662,433, providing the advantage that the grip and hence the ski pole is not moved in position when the skier opens his hand. Unfortunately, a retention strap across the back of a skier's hand allows the grip to rotate slightly with each pole plant. This has made it impractical to use the backhand location for the fingers of the improved strapless grip illustrated in my copending application Ser. No. 391,690. In sum, a grip which combines a true quick-release feature with adequate support and retention characteristics has not been previously available.

SUMMARY OF THE INVENTION

In accordance with the present invention, an improved ski pole grip overcomes all of the above noted disadvantages of prior strapless grips and prior grips with quick-release type straps. A strap means, in the form of a continuous strap or a resilient finger of a strapless grip, is located across the back of the skier's hand, so that the pole position is unchanged when the skier's hand is opened. The grip body is triangular in shape and has a wide platform base which supports the skier's hand back to the wrist. The triangular body positively resists the rotational forces which occur during each pole plant.

One object of this invention is the provision of an improved ski pole grip having strap means located across the back of a skier's hand in combination with a grip body formed to positively resist the turning forces which otherwise would undesirably rotate the grip body during pole plants.

Another object of this invention is the provision of a ski pole grip of the strapless type with improved support and retention of a skier's hand.

Further objects and features of the invention will be apparent from the following description and from the drawings. While an illustrative embodiment of the invention is shown in the drawings and will be described in detail herein, the invention is susceptible of embodiment in many different forms and it should be understood that the present disclosure is to be considered as an exemplification of the principles of the invention and is not intended to limit the invention to the embodiment illustrated.

DESCRIPTION OF THE PREFERRED EMBODIMENT

Figure 1:
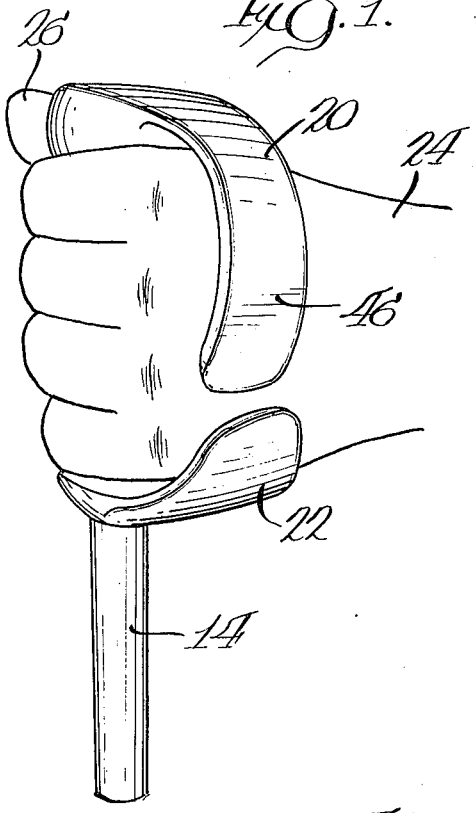
FIG. 1 is a perspective view, taken from the left side of a skier of the novel ski pole grip being held by the left hand of the skier.
Figure 2:
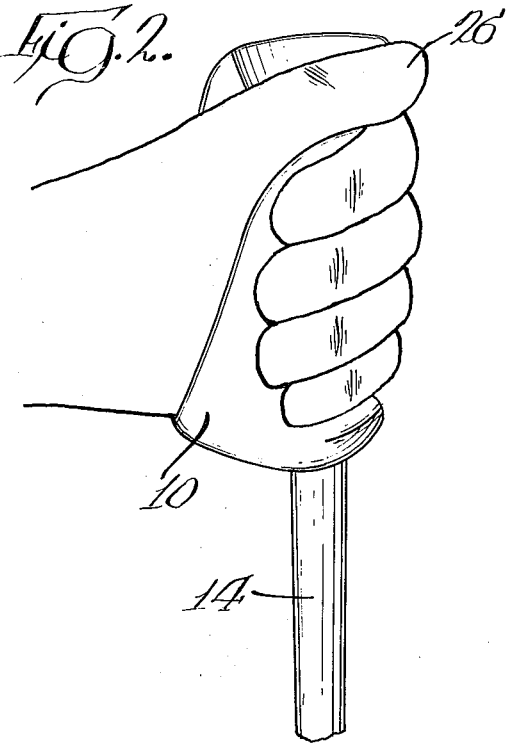
FIG. 2 is a perspective view, similar to FIG. 1, taken from the right side of the skier.
Figure 3:
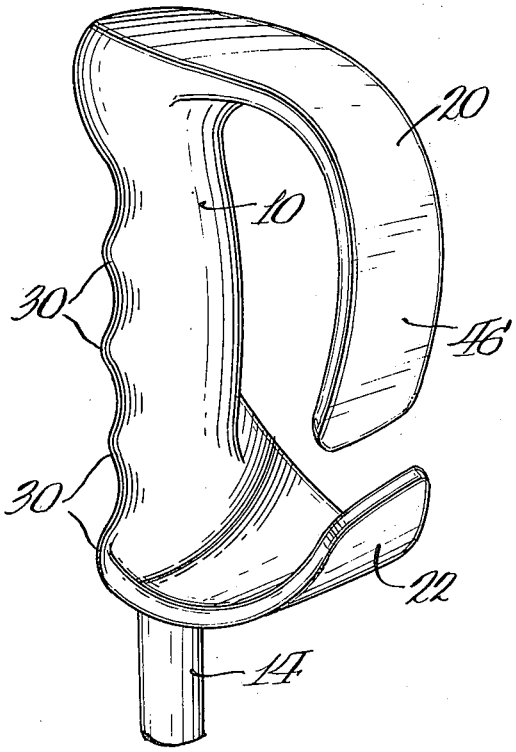
FIG. 3 is a perspective view of the grip itself, shown slightly elevated from the view in FIG. 1.
Figure 4:
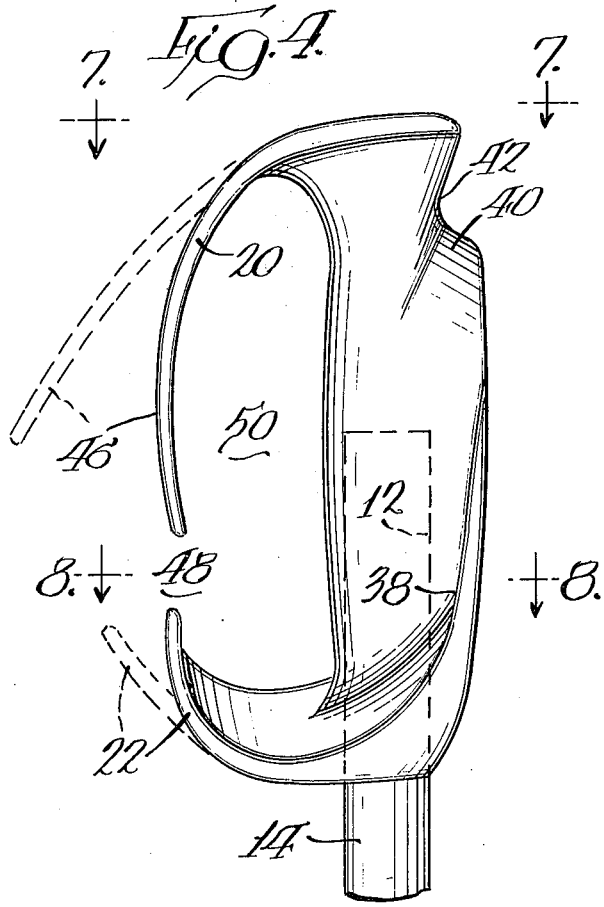
FIG. 4 is a back plane view of the grip.

Referring to the drawings, the novel ski pole grip has an elongated body 10 with an axial bore 12, see FIG. 4, for receiving the shaft 14 of a ski pole. The bore 12 extends for approximately one-half the length of the body 10, and is coaxial with the ski pole shaft 14. Integral with the elongated body 10 and extending from the ends thereof are a resilient upper projecting finger 20 and a resilient lower projecting finger 22. As seen in FIG. 1, the pair of fingers 20 and 22 are oriented to fall across the back of the skier's gloved hand 24. The skier's thumb 26 extends around the opposite side of the body 10 to allow the skier's hand to firmly grasp the grip.

Figure 5:
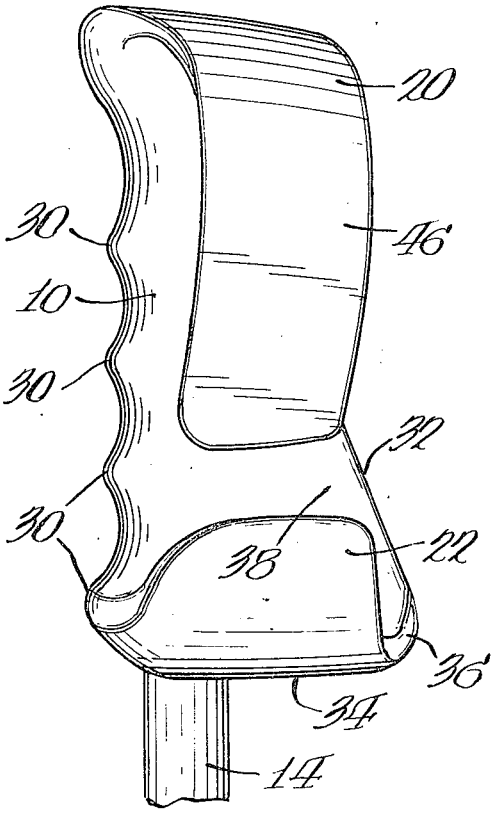
FIG. 5 is a left side view of the grip.
Figure 6:
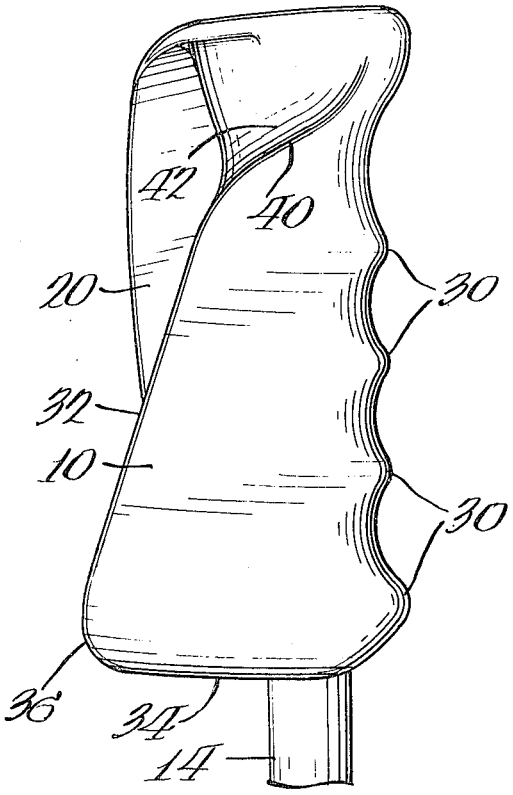
FIG. 6 is a right side view of the grip.
Figure 7:
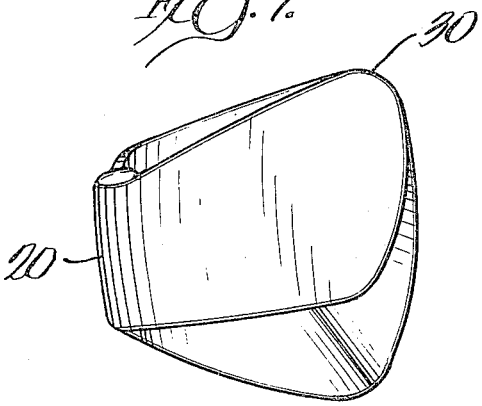
FIG. 7 is a top view taken along lines 7—7 of FIG. 4.
Figure 8:
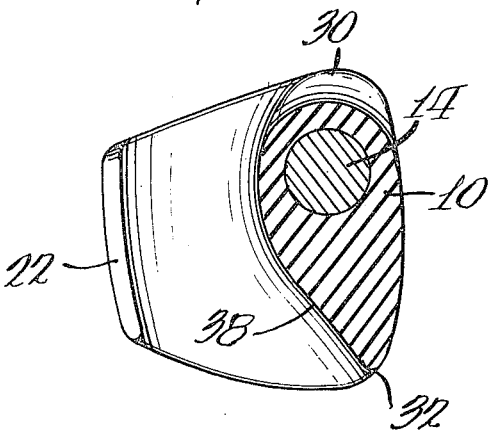
FIG. 8 is a sectional view taken along lines 8—8 of FIG. 4.

The grip body 10 has a generally vertical forward facing surface or area defined by a series of ridges 30 and associated valleys therebetween for receiving the four fingers of the skier's hand. The rear 32 of the grip body has an increasingly radial (i.e. lateral) extent which terminates in a wide base 34 which has a rear edge 36 located approximately at the skier's wrist. As best seen in FIGS. 5 and 6, the forward surface is radially located away from the axial bore by a first distance less than the diameter of the bore 12 (and shaft 14), whereas the rear edge 36 is radially located away by a second distance slightly over two diameters of the bore 12 (and shaft 14). In cross section, see FIG. 8, the grip body has a somewhat vane or airfoil shape, with the inner contour or strap surface 38 conforming with the palm of the skier's hand when grasping the grip. The radially extending stop 38 prevents the grip from rotating in the skier's hand due to the slight turning torque which is sometimes produced during a pole plant.

The palm engaging stop member 38 has a triangular shape, see FIG. 6, defined by the generally vertical front, the generally horizontal base 34 at a right angle to the front, and the sloping side or rear 32. The stop member slopes upwardly and inwardly toward the top of the grip, and finally curves forwardly to define a thumb rest 40. The broad interior support surface 42 of the thumb rest 40 is located at the narrowest cross-section of the grip body 10. The combination of the separate thumb rest 40, and the triangular stop member 38 which extends rearwardly to about the wrist of the skier provides greatly increased contact with the skier's hand and positively prevents rotation about the axis of the ski pole 14.

The integral projecting finger 20 at the top of the elongated body 10 is relatively wide, and curves laterally outward and axially downward with a substantial side section 46 generally parallel to and offset from the center axis of the body 10. The axial or side finger section 46 preferably extends below the mid-point of the body 10, that is, the axial section 46 has a length greater than the majority of the length of the channel which corresponds to the grip area.

The integral lower finger 22 which extends from the wide base 34 smoothly curves into an upturned lower side section which is spaced from the upper side section 46 by a gap 48. The pair of wide side fingers are generally coplanar and define with the central body 10 an open channel 50 the width of the skier's gloved hand.

The ski pole grip may be molded from P.V.C. material having a durometer reading approximately 75 to 85. The hardness and dimensions are selected so that the pair of side fingers are resilient, and can flex or bend. However, the lateral sections, which form the base and upper portion of the side fingers, are essentially rigid in order to respectively define bottom and top platforms for supporting the skier's hand.

To grasp the ski pole, the skier inserts four fingers through the channel 50 and wraps his thumb around the opposite side of the body 10, resting on the thumb rest 40. In this position, the inner surfaces of the resilient side fingers press gently against the back of the skier's gloved hand. The pair of projecting fingers 20, 22 form a retention system which maintains the ski pole in the skier's hand, even though the skier loosens his grip. Furthermore, the skier can entirely open his hand without causing the ski grip to change position.

During an emergency situation, as when the ski pole becomes captured by an object, the skier's hand is pulled rearwardly as the ski pole rotates about the shaft 14. The pair of side fingers will deflect to the side, as seen by the dashed lines of FIG. 4, opening the channel 50. This allows the skier's four fingers to readily slide out of the channel. The upper finger section 46 is constructed to have a substantial side movement, and little upward movement, to prevent inadvertent release during normal skiing conditions. The resulting upper and lower platforms formed by the lateral or radial sections thus support the upper and lower sides of the skier's hand and and resist the large axial pressures which commonly occur during pole planting and normal skiing conditions, While a strapless grip has been illustrated, which can be considered a split-strap retention system, many advantages can still be obtained by replacing the side fingers 20, 22 with a quick-release safety strap, which may include a buckle for length adjustment. Although safety release would be impaired somewhat, the grip would still provide sufficient safety for most skiing conditions, while incorporating the advantages of an across the back of the hand location, and a generally triangular palm stop which resists turning. To improve safety, the continuous strap could be connected to the top and/or bottom of the grip through a snap or other release mechanism which would separate under force.

When the split-strap (strapless) retention system is utilized, as illustrated, the gap 48 should not be lengthened to an appreciable extent, as this would reduce the retention capabilities produced by the overlying side finger 22. While the primary release finger has been illustrated as being the upper finger, the positions of the upper and lower fingers could be reversed. Also, the upper and lower fingers could be made substantially the same length, and define therebetween a gap located at the mid-point of the ski grip. In such a case, both the upper and lower fingers could be used to press against the back of the skier's hand, for improved support when the skier loosens his grip. Other modifications will be apparent in view of the above teachings.

I claim:

1. A strapless ski pole grip, comprising:

an elongated body member with an axial bore for receiving a shaft of a ski pole, the body member having a forward grip section extending radially by a first distance from the axial bore for receiving the fingers of the skier's hand and a rear palm engaging section extending radially by a second distance substantially greater than the first distance for abutting the palm of the skier's hand to prevent rotation of the elongated body member, and a resilient side finger extending radially outward from one end of the body member and then axially therefrom to define a side section generally parallel with the axial bore and offset from the elongated body member to form therebetween a channel for containing the skier's hand, the side section being oriented to extend across the back of the skier's hand when grasping the elongated body member and to deflect radially to open the channel and allow release of the skier's hand.

2. The strapless ski pole grip of claim 1 wherein the first distance is less than the diameter of the axial bore, and the second distance is on the order of two diameters of the axial bore.

3. The strapless ski pole grip of claim 1 wherein the rear palm engaging section has a slanting rear edge having an increasing radial extent away from a generally vertical front of the forward grip section with the slanting rear edge extending towards the bottom of the elongated body member, the slanting rear edge, generally vertical front, and the bottom of the elongated body member defining a generally triangular shape, the rear palm engaging section forming a wide platform for supporting the bottom of the skier's hand.

4. The strapless ski pole grip of claim 3 wherein the wide platform extends rearward to the wrist of the skier's hand.

5. The strapless ski pole grip of claim 3 wherein the slanting rear edge at its upper extent defines a broad support surface for supporting the thumb of the skier's hand.

6. The strapless ski pole grip of claim 1 wherein said body member terminates axially in upper and lower ends having radial sections which form upper and lower platforms for supporting the upper and lower portions of the skier's hand when grasping the elongated body member, the radial outward extent of the resilient side finger corresponding to one of the upper and lower radial sections

7. A strapless ski pole grip, comprising:

an elongated body member with an axial bore for receiving the shaft of a ski pole, the elongated body member having a forward facing grip surface for receiving the fingers of the skier's hand and side facing surfaces one of which is engaged by the palm of the skier's hand and the opposite of which is engaged by the thumb of the skier's hand when the skier's hand grasps the elongated body member a resilient side finger extending radially outward at an end of the body member and then axially therefrom to form a side section offset from and parallel with the body member, the side section and the body member defining therebetween a channel for containing the skier's hand when grasping the grip section, the side section deflecting to release the skier's hand when the ski pole becomes trapped during use, the side finger extending radially outward from the one side facing surface opposite the thumb side surface to cause the side section to lie adjacent the back of the skier's hand when gripping the elongated body member.

8. The strapless ski pole grip of claim 7 wherein the elongated body member has at its opposite end a second resilient finger extending outward in radial and then axial directions, the radial extents of the resilient fingers forming upper and lower platforms for supporting the upper and lower portions of a skier's hand when grasping the elongated body member.

9. The strapless ski pole grip of claim 8 wherein the lower platform has a backward extent substantially greater than its forward extent to form a wide base for supporting the bottom of the skier's hand back to the wrist.

10. The strapless ski pole grip of claim 7 wherein the side finger extends axially to beyond the mid-point of the elongated body member and has a resiliency to allow substantial side movement in order to release the skier's hand.

* * * * *